US007194840B2

(12) United States Patent
Zimmermann

(10) Patent No.: US 7,194,840 B2
(45) **Date of Patent: *Mar. 27, 2007**

(54) CLOSURE OPERATOR HAVING A HANDLE THAT ROTATES AS THE CLOSURE ROTATES

(76) Inventor: Eric Zimmermann, 25-74 31st St., Astoria, NY (US) 11102

( * ) Notice: Subject to any disclaimer, the term of this patent is extended or adjusted under 35 U.S.C. 154(b) by 88 days.

This patent is subject to a terminal disclaimer.

(21) Appl. No.: 10/750,577

(22) Filed: Dec. 29, 2003

(65) Prior Publication Data

US 2005/0144846 A1 Jul. 7, 2005

Related U.S. Application Data

(63) Continuation-in-part of application No. PCT/US02/20917, filed on Jul. 1, 2002, which is a continuation-in-part of application No. 09/896,744, filed on Jun. 29, 2001, now Pat. No. 6,574,921.

(51) Int. Cl.
*E05F 11/54* (2006.01)

(52) U.S. Cl. ..... 49/324; 49/460; 49/333

(58) Field of Classification Search ..... 49/460, 49/461, 324, 333, 335, 336, 338, 32; 16/412, 16/429, 438

See application file for complete search history.

(56) References Cited

U.S. PATENT DOCUMENTS

| | | | | | |
|---|---|---|---|---|---|
| 259,191 | A | * | 6/1882 | Merrill | 49/74.1 |
| 270,310 | A | * | 1/1883 | Harrison | 49/335 |
| 393,401 | A | | 11/1888 | Shatsick | |
| 761,290 | A | | 5/1904 | Fagan | |
| 1,220,144 | A | | 3/1917 | Jones | |
| 1,539,155 | A | | 5/1925 | Brandt | |
| 1,663,175 | A | | 3/1928 | Putnam | |
| 1,670,921 | A | * | 5/1928 | Zimmer | 49/335 |
| 1,833,121 | A | | 11/1931 | Norton | |
| 2,294,041 | A | * | 8/1942 | Mims | 49/358 |
| 2,320,096 | A | | 5/1943 | Persson | |
| 2,576,536 | A | | 11/1951 | Reynaud | |
| 2,827,284 | A | * | 3/1958 | Bunzl | 49/32 |
| 3,085,297 | A | | 4/1963 | Linderfelt | |
| 3,385,655 | A | | 5/1968 | Huston et al. | |

(Continued)

OTHER PUBLICATIONS

International Search Report, PCT/US04/43617, filing date Oct. 28, 2005.

(Continued)

*Primary Examiner*—Gregory J. Strimbu
(74) *Attorney, Agent, or Firm*—Collard & Roe, P.C.

(57) ABSTRACT

A portal covering such as door or window having a handle that rotates as the door or window rotates. The handle rotatably mounted onto the portal covering and drives the covering around an axis associated with a frame or wall. As the handle is rotated on its axis on the covering, the covering rotates on its axis on the frame. This allows a user to always have contact with the handle at all angles of rotation of the covering. The rotation is accomplished through a direct drive or a gearing system which in this case could be in the form of a miter gear, or other bevel gears linking two shafts together. Other embodiments are also possible such as drive mechanisms associated with a push plate, cables and pulleys, or gear boxes.

20 Claims, 13 Drawing Sheets

U.S. PATENT DOCUMENTS 4,192,203 A * 3/1980 Dailey ..... 477/51
4,860,493 A 8/1989 Lense
4,945,679 A 8/1990 Aumercier
5,542,213 A * 8/1996 Freeman ..... 49/221
5,910,077 A * 6/1999 Aumiller et al. ..... 49/460
6,122,863 A 9/2000 Tippin et al.
6,135,536 A * 10/2000 Ciavaglia et al. ..... 296/146.4
6,298,604 B1 * 10/2001 Rogers et al. ..... 49/340
2001/0005084 A1 * 6/2001 Ponziani ..... 296/56

OTHER PUBLICATIONS

International Search Report, PCT/US02/20917, filing date Mar. 2, 2003.

* cited by examiner

FIG. 11D
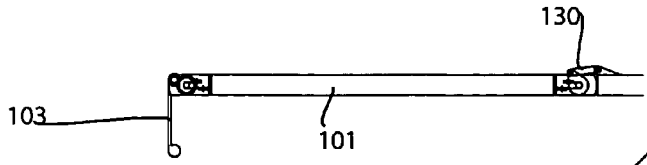
FIG. 11C
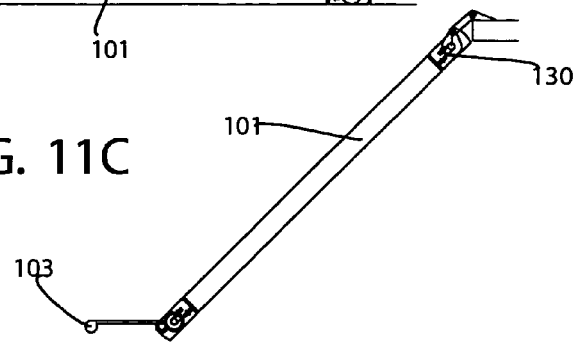
FIG. 11B
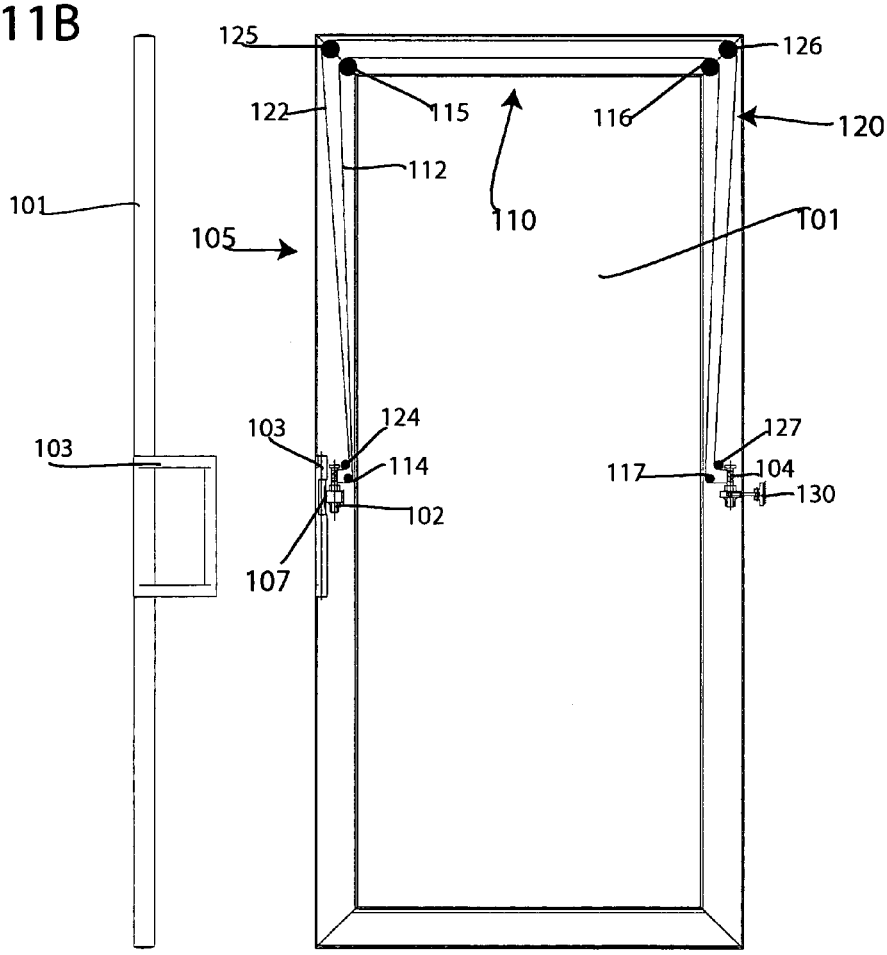
FIG. 11A

FIG. 12C
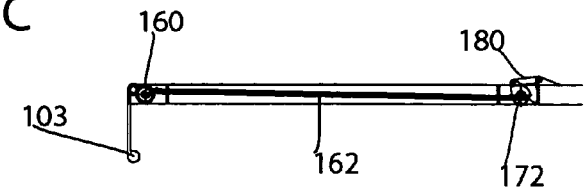
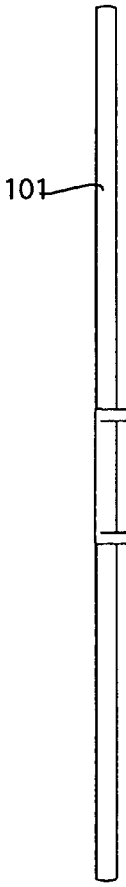
FIG. 12B
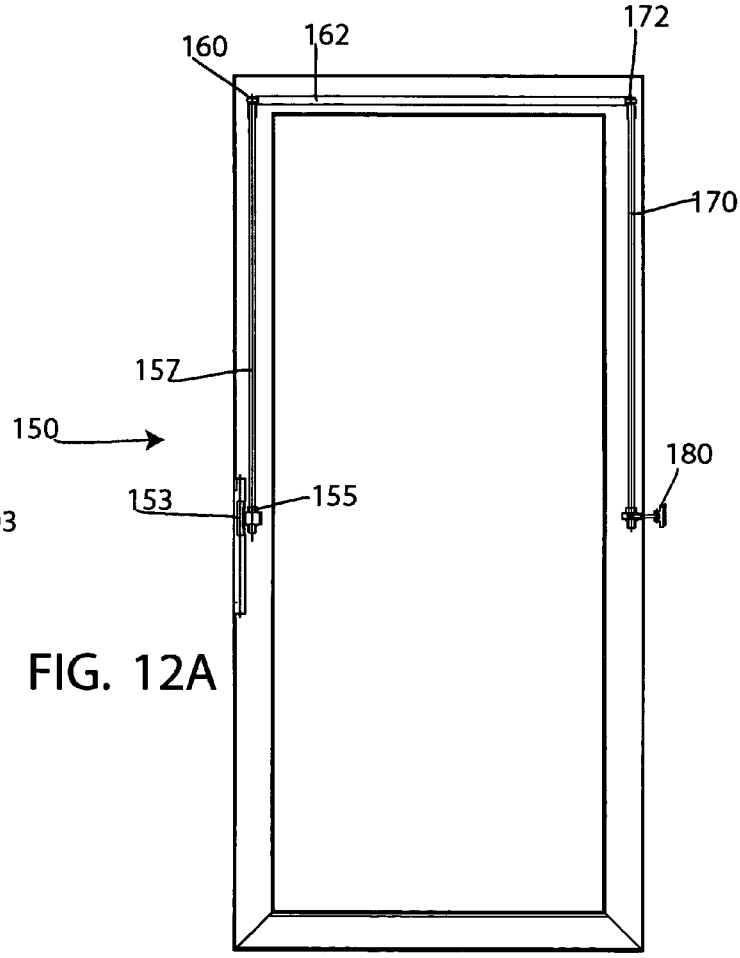
FIG. 12A

CLOSURE OPERATOR HAVING A HANDLE THAT ROTATES AS THE CLOSURE ROTATES

CROSS REFERENCE TO RELATED APPLICATIONS

This application is a continuation in part application of international application No. PCT/US02/20917 filed on Jul. 1, 2002 which is a continuation in part application of U.S. patent application Ser. No. 09/896,744 filed on Jun. 29, 2001 now issued as U.S. Pat. No. 6,574,921 on Jun. 10, 2003.

BACKGROUND

Handles for doors, windows and other portal coverings are known in the art. For example, the following references show doors or windows that work with handles U.S. Pat. Nos. 6,122,863; 4,945,679; 4,860,493; 2,576,536; 1,663,175; 1,539,155; 1,220,144 all incorporated herein by reference.

The present state of the art suffers from the following problem in that none of the references cited above disclose the use of a handle that rotates with the window or door as it is opening or closing thus allowing the user an easier grasp of the door or window, nor a handle that drives a door or window open or closed.

SUMMARY

The present invention relates to a system that was designed to overcome the problem of the references cited above by presenting a portal covering such as door or window having a handle that rotates as the door or window rotates. Essentially this portal covering includes a handle, that is rotatably mounted onto the portal covering and that drives the door around an axis associated with a frame or wall. The handle is coupled to a shaft that is coupled to the portal covering via couplings which have bearings. On an end of the shaft is a bevel gear that meshes with an adjacent bevel gear. The adjacent gear is coupled to a shaft extending on a different axis from the first shaft. There is also a second, oppositely spaced gear positioned on this second shaft opposite the first gear. This second gear on the second shaft couples with a fixed gear that is fixed to a cover frame such as a door frame or a window frame. As the handle is rotated on its axis on the cover, the cover rotates on its axis on the frame. Similarly, as the cover rotates within the frame, the handle rotates with this rotating cover allowing a user to always have contact with the handle at all angles of rotation of the cover.

The gears in this case could be in the form of a miter gear, a or other bevel gears or a direct drive linking two shafts together. Other embodiments are also possible such as drive mechanisms associated with a push plate, cables and pulleys, gear boxes, push plates or any other type of drive system that incorporates the rotational movement of a handle which translates into the rotational movement of a door.

BRIEF DESCRIPTION OF THE DRAWINGS

Other objects and features of the present invention will become apparent from the following detailed description considered in connection with the accompanying drawings which disclose at least one embodiment of the present invention. It should be understood, however, that the drawings are designed for the purpose of illustration only and not as a definition of the limits of the invention.

In the drawings, wherein similar reference characters denote similar elements throughout the several views:

FIG. 11A discloses an open front view of another embodiment of the invention;

FIG. 11B is a side view of the embodiment shown in FIG. 11A;

FIG. 11C is a top view of the embodiment shown in FIG. 11A in an open position;

FIG. 11D is a top view of the embodiment shown in FIG. 11A wherein the door is in a closed position;

FIG. 12A is a front exposed view of another embodiment of the invention;

FIG. 12B is a side view of the embodiment shown in FIG. 12A;

FIG. 12C is a top view of the embodiment shown in FIG. 12A;

DETAILED DESCRIPTION

Figure 1:
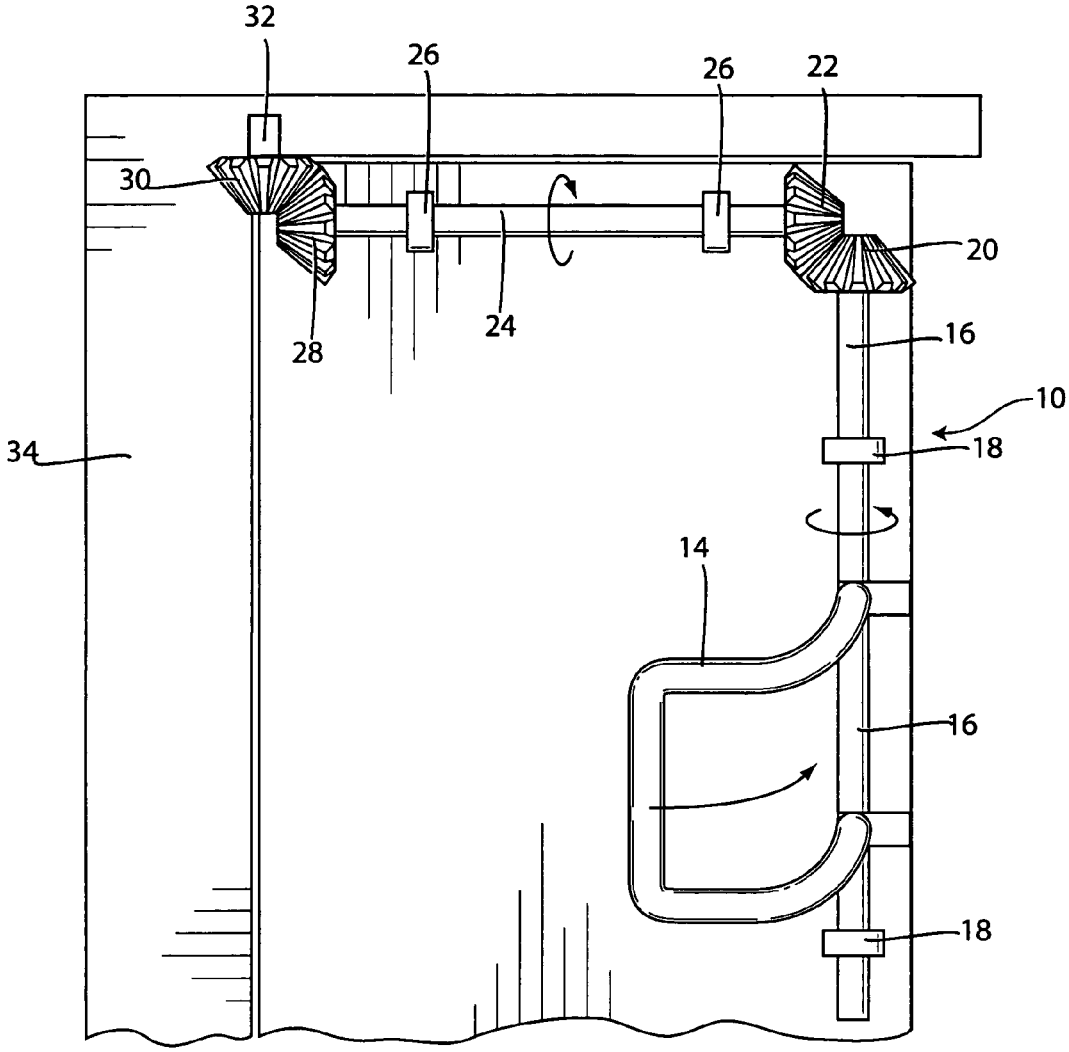
FIG. 1 is a front view of a first embodiment of an open faced cover containing the rotating handle.

FIG. 1 is a front view of a first embodiment of an open-faced portal covering device 10 comprising a portal covering such as a door or window 12 and a rotating handle 14.

Rotating handle 14 can be substantially loop shaped or U-shaped so that a user can grab onto handle 14. Handle 14 is coupled to a rotatable shaft 16 that is rotatably coupled to cover 12 via a series of couplings 18. Disposed at one end of rotatable shaft 16 is a gear 20 such as a bevel gear, that is shaped frusto-conically so that it meshes with an adjacent frusto-conically shaped gear 22.

Frusto-conically shaped gear 22 is coupled to rotatable shaft 24. Rotatable shaft 24 is rotatably coupled to cover 12 via a second series of couplings 26. These couplings 26 allow shaft 24 to rotate inside.

Disposed on an opposite end of gear 22, is gear 28 which rotates as shaft 24 rotates.

Gear 28 meshes with fixed gear 30 which is coupled to shaft 32. Shaft 32 is fixed to door frame 34.

In operation, as a user grabs handle 14, to open door 12, handle 14 rotates, rotating shaft 16. Shaft 16 rotates within couplings 18 so that it turns gear 20. As gear 20 rotates, it rotates gear 22 rotating shaft 24 within couplings 26. Gear 28, which is coupled to rotating shaft 24 rotates with shaft 24 around fixed gear 30. Thus, as a person grabs door handle 14, it automatically starts door or cover 12 turning within its hinges and rotating within frame 34.

Figure 2:
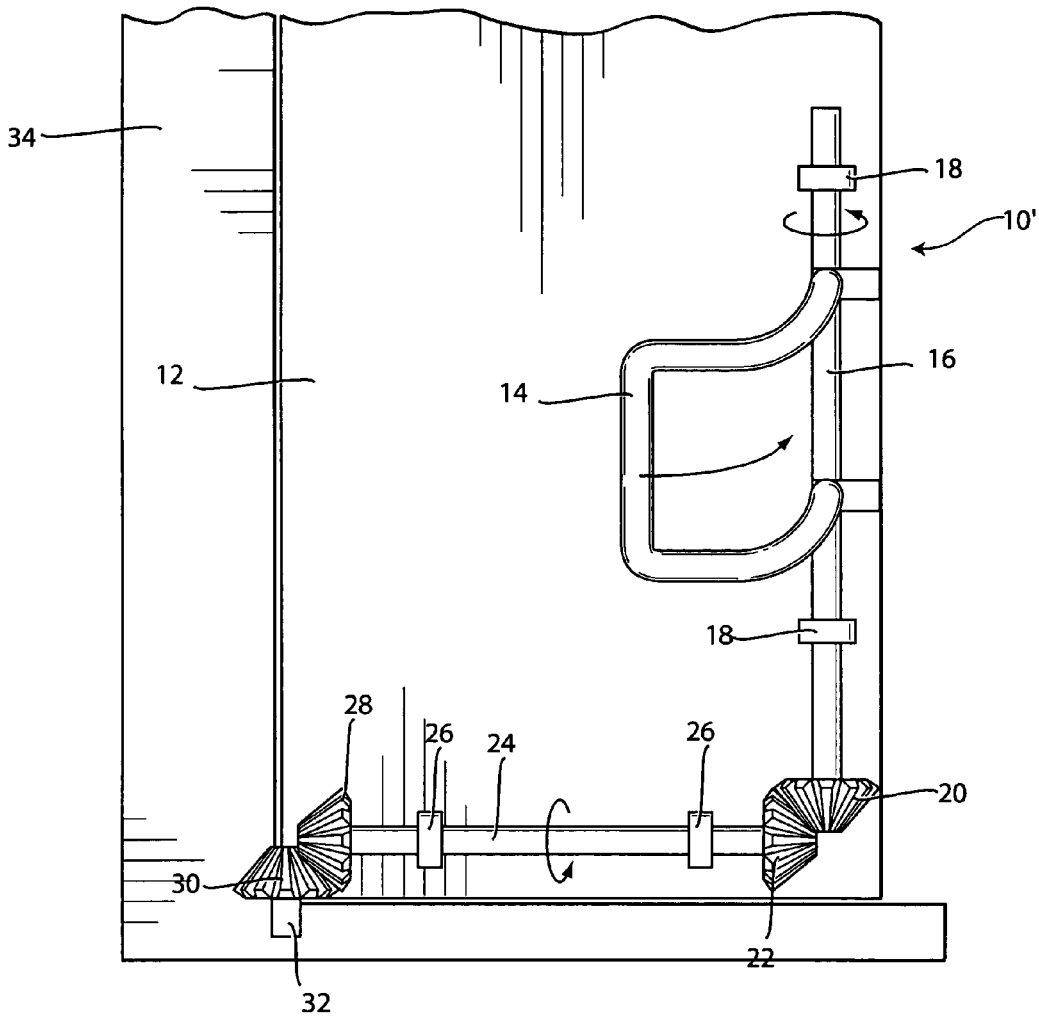
FIG. 2 is a front view of a second embodiment of an open faced cover containing the rotating handle.

FIG. 2 is a front view of a second embodiment of an open door containing the rotating handle. In this embodiment, shaft 24 is placed at the bottom of cover 12 wherein shaft 16 also extends down through couplings 18 so that gear 20 meshes with gear 22. With this design the above listed components work together in a manner similar to that of the first embodiment.

Figure 3:
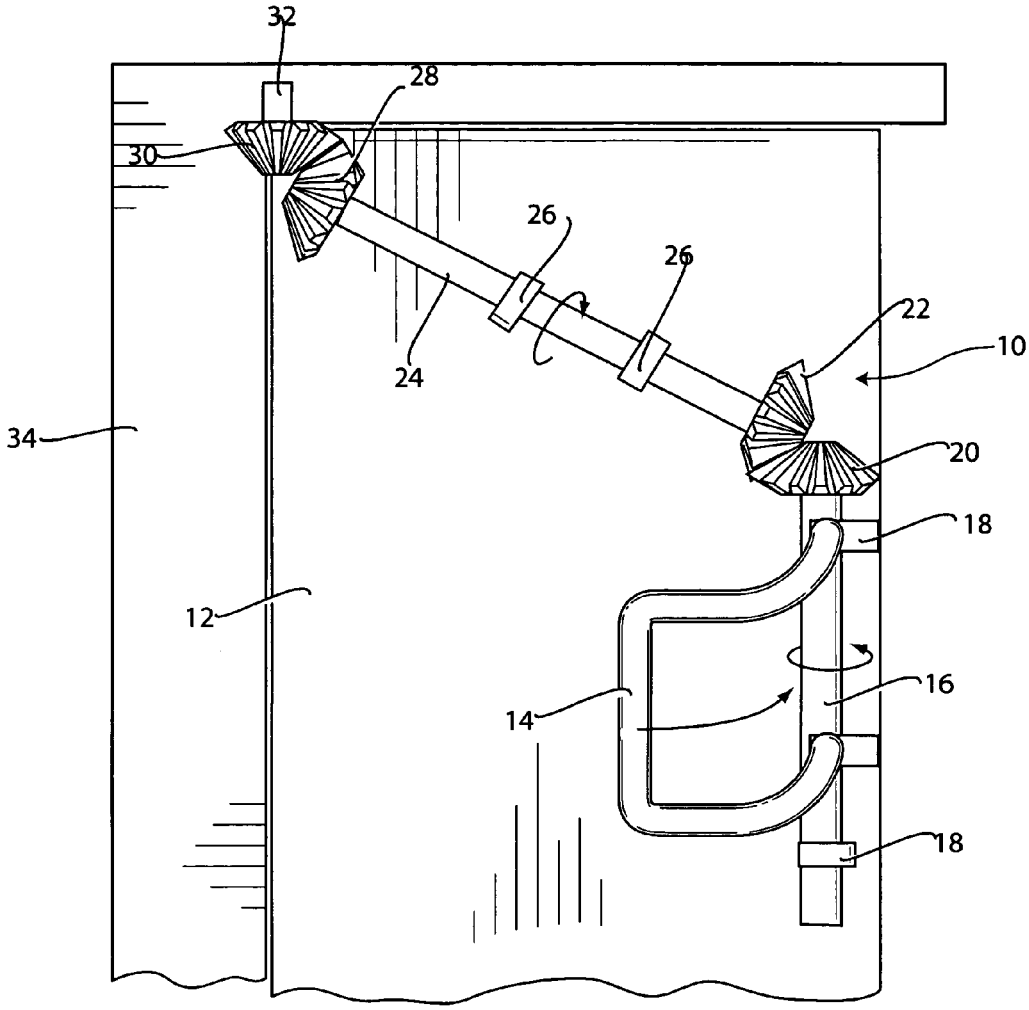
FIG. 3 is a front view of a third embodiment of an open cover containing the rotating handle.

FIG. 3 is a front view of the third embodiment of the invention. With this design, shaft 24 extends diagonally down from stationary gear 30 to gear 20, so that gear 28 meshes with gear 30 and gear 22 meshes with gear 20. Couplings 26 hold shaft 24 in place so that while gear 22 rotates with gear 20 shaft 24 revolves around a single axis.

Figure 4:
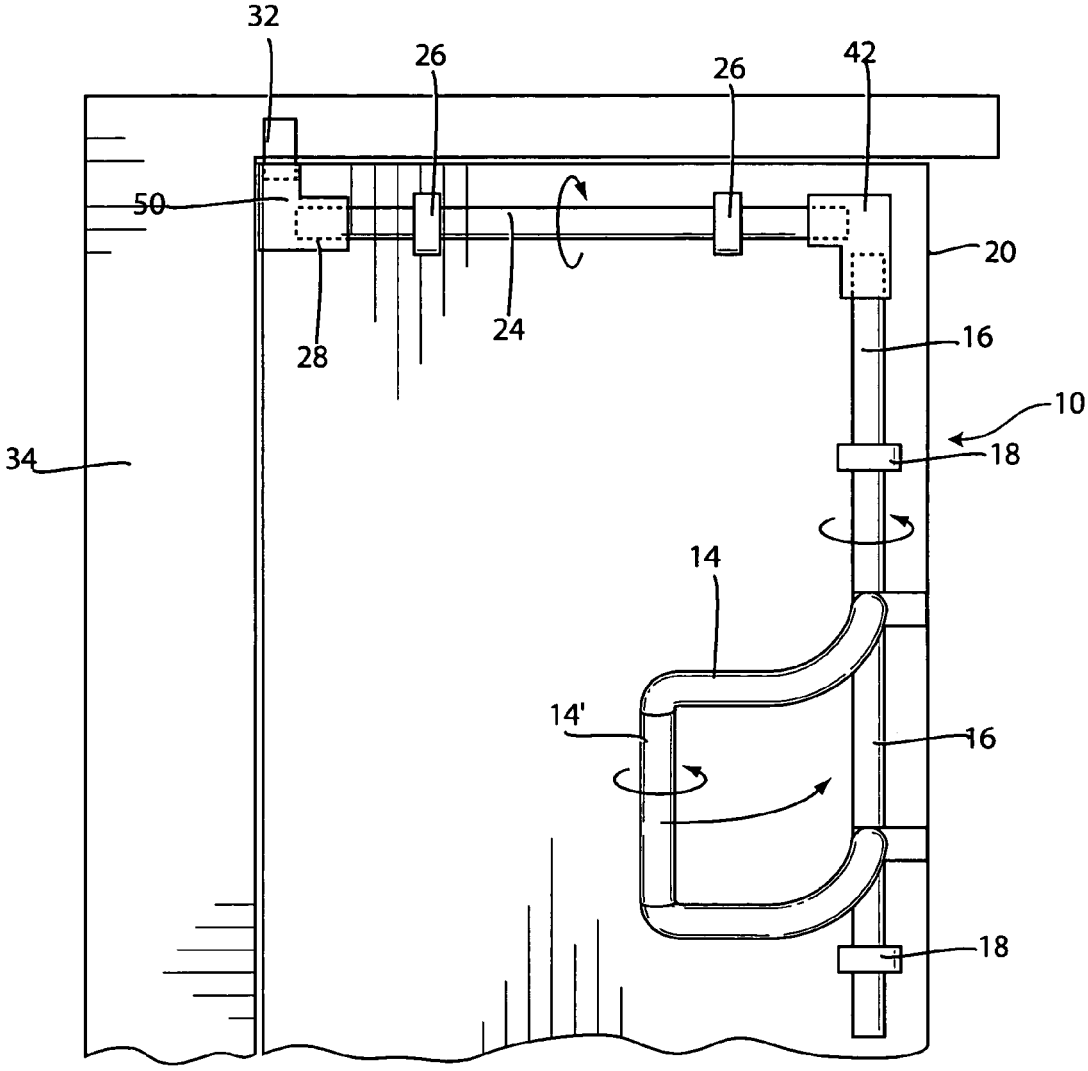
FIG. 4 is a front view of a fourth embodiment of the invention showing gear boxes.

FIG. 4 is a front view of an open faced cover wherein in this embodiment, there are two direct drives 42, and 50 that are used in place of gears 20 and 22, and 28 and 30 respectively. Direct drives are essentially closed compartments of meshed gears that can be either bevel gears, miter gears, worm gears or any other type of joining apparatus that is used to join to rotatable shafts together at a substantially right angle. In addition, in this embodiment, handle 14 has a rotatable center region 14' which allows this center region to rotate about a vertical axis as the entire handle 14 rotates within cover 12. In that way, the user does not have to loosen his or her grip on handle 14 as it is rotating.

All embodiments provide the benefit of a door handle that rotates with a door as the door rotates. This handle type arrangement is designed to both rotate in response to the rotation of the door or window but also to help initiate the rotation of the door or window.

When a user pulls on handle 14, it starts shaft 16 rotating thus starting gear 20 rotating as well. As gear 20 rotates it rotates gear 22 thus also turning shaft 24 and opposite gear 28.

The initiation of rotation of gear 28 against stationary gear 30 starts covering 12 rotating within frame 34.

Figure 5:
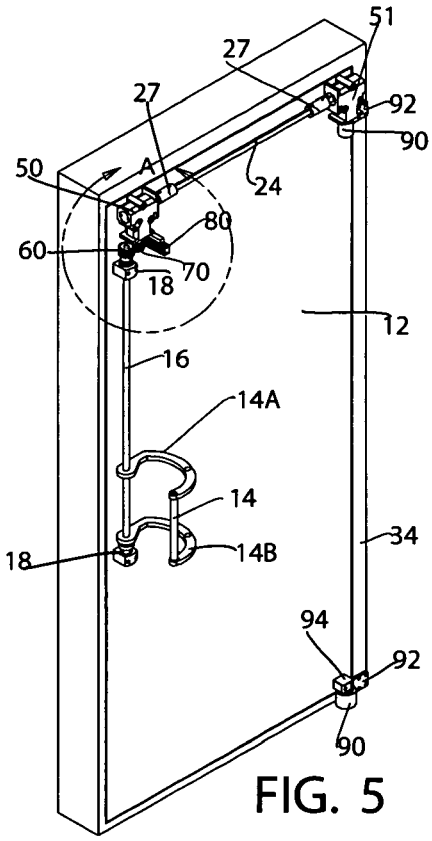
FIG. 5 is a perspective view of another embodiment of the invention wherein there is shown an offset handle shaft.

FIG. 5 is a perspective view of another embodiment of the invention wherein there is shown an offset handle shaft 16. This offset handle shaft 16 is coupled to handle 14 having curved handle supports 14A and 14B. Couplings 18 hold shaft 16 to door 12 wherein shaft 16 rotates within couplings 18. Adjacent to a top coupling 18 is a spur gear 60 which rotates with shaft 16. There is also an additional spur gear 70 which meshes with spur gear 60 and also with toothed rack 80. There is an L-shaped gear box 50 which is coupled to spur gear 70 via a shaft (not shown). Thus, as spur gear 60 rotates from handle 14 rotating, spur gear 70 rotates causing gears disposed inside gear box 50 to rotate to cause shaft 24 to rotate.

Figure 6:
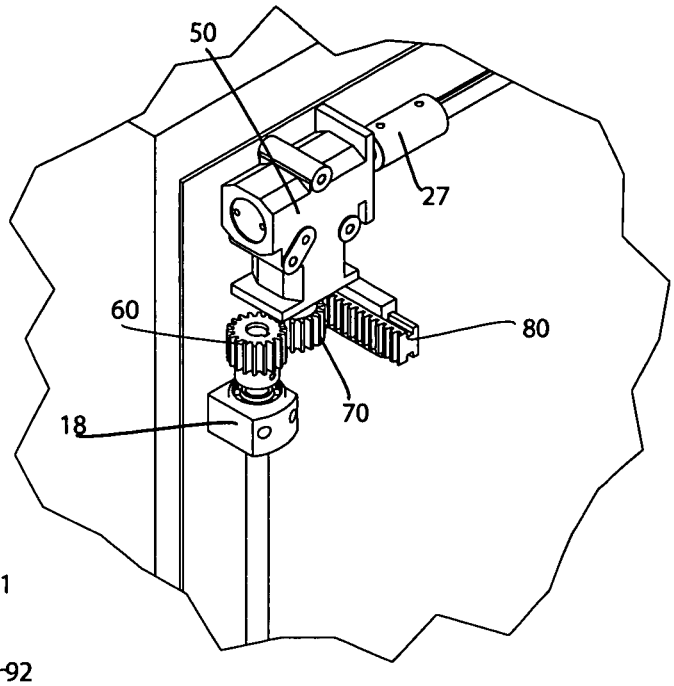
FIG. 6, is a close up view of a connection between an offset handle shaft and an L-shaped gear box.

Coupled to shaft 24 are shaft couplings 27 which allow shaft 24 to rotate. There is also an additional gear box 51 which contains a fixed gear disposed therein. The fixed gear serves as a fixed rotation point which causes the door to rotate as shaft 24 rotates (See FIG. 1). The fixed gear has a shaft that extends into a frame coupling 90 which is attached via a plate 92 to a frame 34. FIG. 6, is a close up view of a connection between an offset handle shaft and an L-shaped gear box 50.

Figure 7:
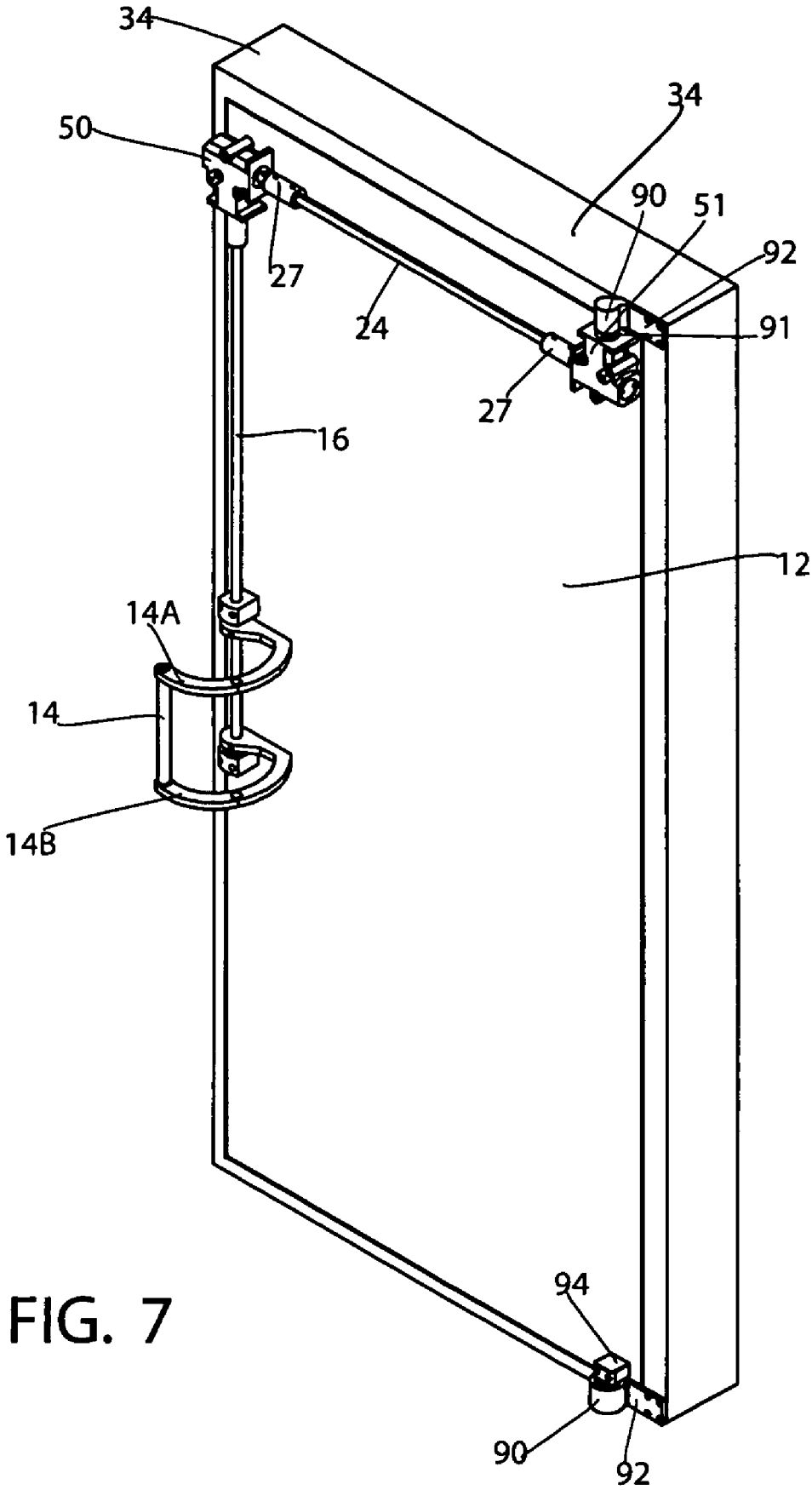
FIG. 7 is a perspective view of a door having L-shaped gear boxes in alignment with the handle shaft and disposed inside of the door.

FIG. 7 is a perspective view of a door 12 having L-shaped gear boxes 50 and 51 in alignment with the handle shaft 16 and disposed on an inside section of the door 12. The second gear box 51 is attached to door 12 so that there is a fixed shaft 91 which extends into frame coupling 90. Frame coupling 90 is coupled to frame 34 via plate 92. With this design, frame coupling 90 and pin block 94 are both disposed on door 12 so that they can be easily attached to frame 34.

Figure 8:
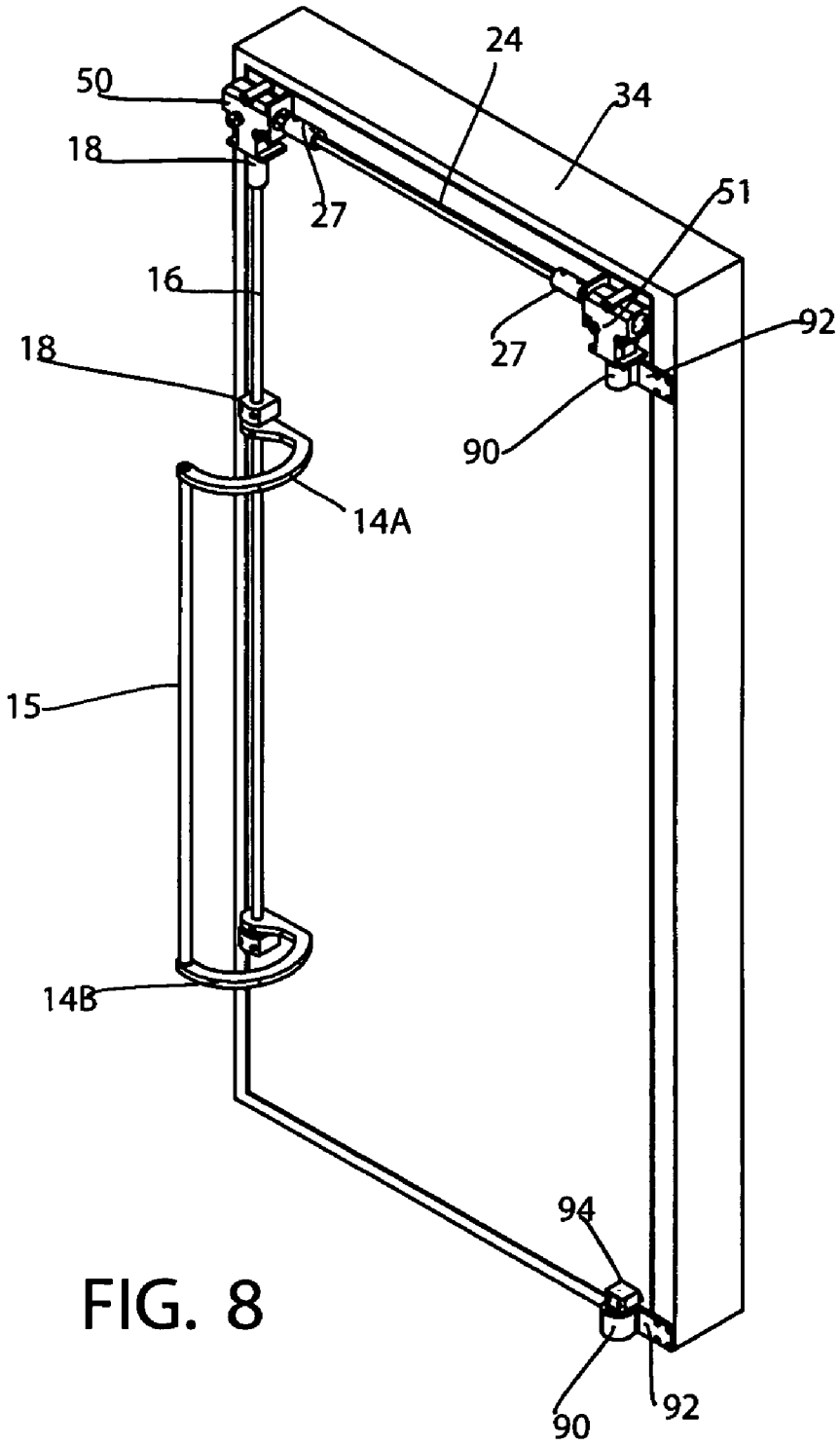
FIG. 8 is a perspective view of a door with an elongated handle.

FIG. 8 is a perspective view of door 12 with an elongated handle 15. Elongated handle 15 is designed so that it is easier for a user to grab onto a handle and rotate that handle.

With this design, handle 15 extends from a lower coupling 18 to an upper coupling 18 and is coupled on both ends by handle supports 14A and 14B.

Figure 9:
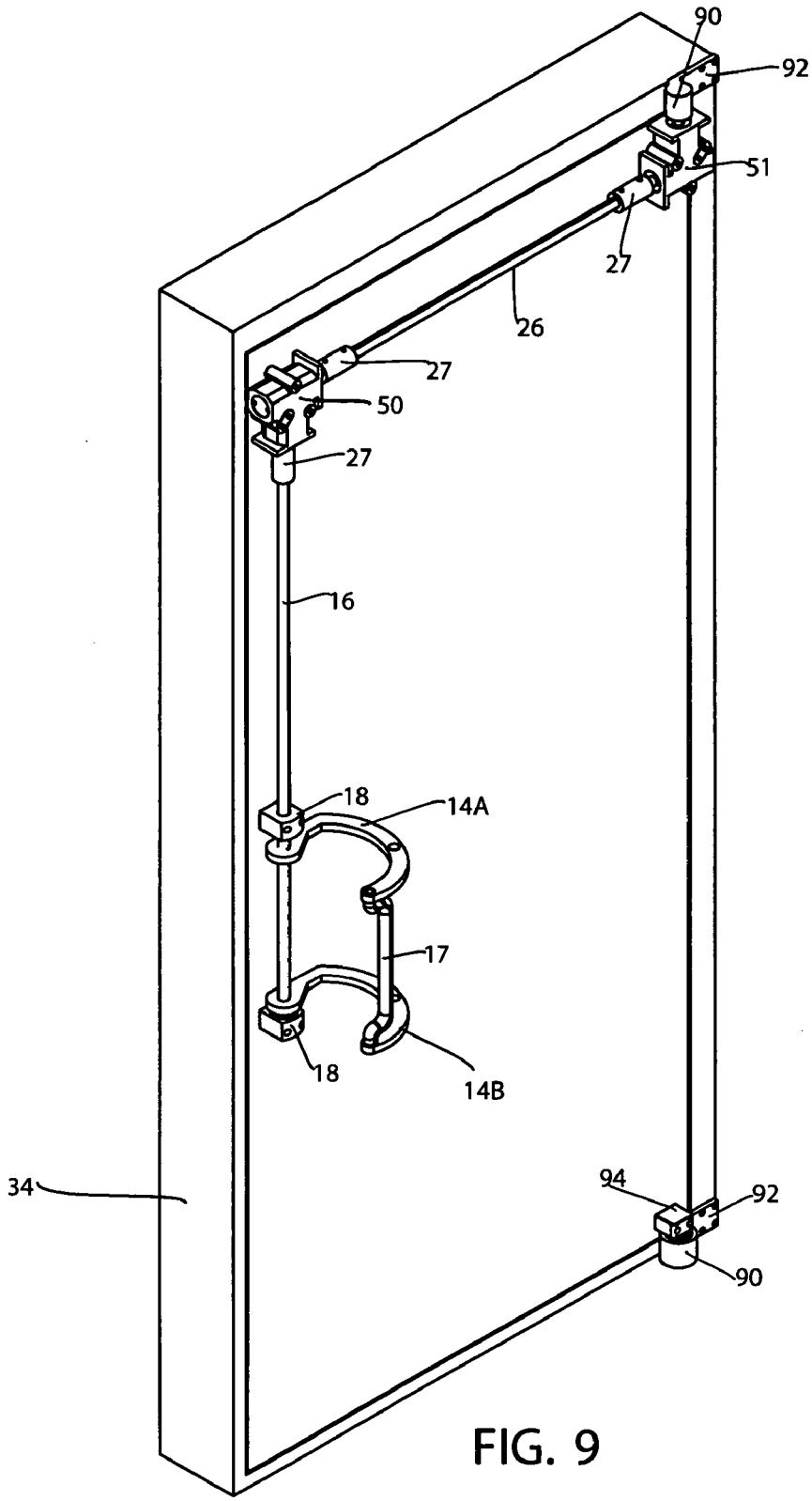
FIG. 9 is a perspective view of a door with a double rotatable handle.

FIG. 9 is a perspective view of a door with a double rotatable handle 17. This double rotatable handle 17 is rotatably attached to handle supports 14A and 14B and is freely rotatable within handle supports 14A and 14B so that as a user rotates handle 17 about door 12 via shaft 16, handle 17 rotates as well to aid the user in an easy grip of handle 17.

Figure 10:
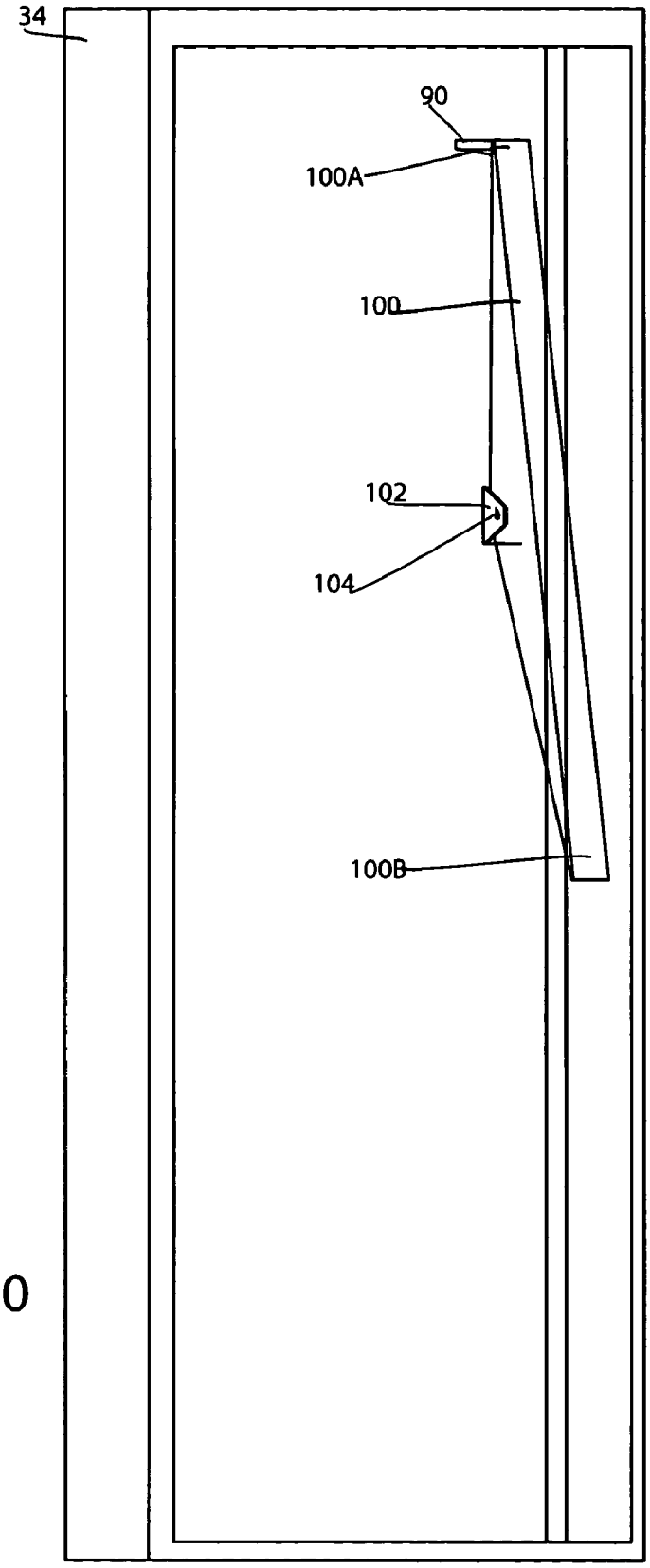
FIG. 10 is a perspective view of a door with a push lever disposed on the door opposite the handle for pushing open the door.

FIG. 10 is a perspective view of a door with a push lever 100 disposed on the door opposite the handle for pushing open the door 12. Push lever 100 is coupled to door 12 via a plate 102 and a pin 104. Push lever 100 has a top end 100A which is coupled at one end to rack 80 so that when a user pushes a bottom end 100B of lever 100 top end 100B moves forward pulling rack 80 with it. As rack 80 moves, spur gear 70 rotates rotating spur gear 60 and the gears in gear housing 50 which then rotates shaft 24 and the gears in housing 51 which then rotate around fixed shaft 91 causing door 12 to rotate within frame 34. The distance of bottom end 100B from pin 104 creates an additional moment force which adds leverage for the user.

FIG. 11A discloses an open front view of another embodiment of the invention wherein with this design, there is a door 101 with a pulley system 105 that is used to activate the door and handle connection. Pulley system 105 includes spindles 102 and 104 positioned at each end along with a first pulley subsystem 110 and a second pulley subsystem 120. First pulley subsystem 110 includes a pulley cable or string, 112, a set of pulley wheels 114, 115, 116 and 117 coupled inside of a track in door 101. First wheel 114 is positioned adjacent to rotating spindle 102 so that cable 112 feeds through first wheel 114 and substantially vertically up to second wheel 115. Cable 112 wraps around cable 112 and then extends horizontally out to third wheel 116. This cable 112 then wraps down to fourth wheel 117 wherein the cable wraps around fourth wheel 117 and is then attached to spindle 104.

Second pulley system 120 is structured substantially similar to first pulley system 110. Second pulley system includes a pulley cable or string, 122, a set of pulley wheels 124, 125, 126 and 127 coupled inside of a track in door 101. First wheel 124 is positioned adjacent to rotating spindle 102 so that cable 122 feeds through first wheel 124 and substantially vertically up to second wheel 125. Cable 122 wraps around wheel 125 and then extends horizontally out to third wheel 126. This cable 122 then wraps down to fourth wheel 127 wherein the cable wraps around fourth wheel 127 and is then attached to spindle 104. Spindle 104 is fixed in place by a stationary bracket 130 wherein this stationary bracket 130 is coupled to an associated wall or door frame, such that door 101 pivots on any known hinge system.

FIG. 11B shows the side view of door 101 with a handle 103 extending out therefrom. FIGS. 11C and 11D show top views of door 101 in both an open and closed position.

Essentially, the pulley system works as follows, when handle 103 is turned, spindle rod or shaft 102 rotates so that it pulls on cable 112 and releases cable 122 by unwinding from spindle 104. By pulling on cable 112, it creates tension in cable 112 to cause door 101 to rotate about spindle 104 to release additional cable 112 which is wrapped around spindle 104. This rotation of door 101 around spindle 104 allows an additional length of cable to travel up and around pulley wheels 114, 115, 116 and 117 to allow handle 103 to rotate. When rotating handle 103 back, cable 112 is released, and instead, cable 122 is pulled on so that door 101 rotates back. This occurs because cable 122 is wrapped in an opposite direction from cable 112. Thus, two different pulley systems 110 and 120 may be used because rotation of the door handle creates tension in a particular pulley system in one direction and a release of tension in the opposite direction. With this design there can also be only one single cable so that cable 112 can be used also for second pulley subsystem 120 as well.

FIGS. 12A, 12B and 12C relate to another embodiment of the invention. In this design, there is a pushrod system 150 which is disposed in shafts of door 101. Pushrod system 150 includes a gearing or teeth section 153 coupled to a rod or section of handle 103. Teeth section 153 meshes with teeth section 155 which is coupled to a vertical rod 157. Vertical rod 157 extends up a side of door 101 to a top region of door 101. Coupled to this top region of vertical rod 157 is an offset coupler 160. Offset coupler 160 allows a substantially horizontal rod 162 to be coupled thereto. Substantially horizontal rod 162 is coupled to offset coupler 160 in a manner so that substantially horizontal rod 162 is substantially offset from substantially vertical rod 157. In addition, at an opposite end, substantially horizontal rod 162 is coupled to a second substantially vertical rod 170 via an additional offset coupler 172. Opposite additional offset coupler 172, substantially vertical rod 170 is coupled to a stationary hinge 180.

Thus, the door operates as follows: when a user pulls handle 103, handle 103 in turn rotates gearing or teeth section 153 which meshes with teeth section 155 which then correspondingly rotates substantially vertical rod 157. As substantially vertical rod 157 rotates, it turns offset coupler 160 which then correspondingly pushes or pulls on substantially horizontal rod 162 which is driven by offset coupler 160 by being coupled radially offset from substantially vertical rod 157. This offset coupling is shown in FIG. 12C. As substantially horizontal rod 162 drives axially, it in turn causes door 101 to rotate because second or additional offset coupler 172 is fixed in position. Therefore, to accommodate the movement of substantially horizontal rod 162, door 101 must rotate as horizontal rod 162 pushes or pulls on offset coupler 172.

Figure 13A:
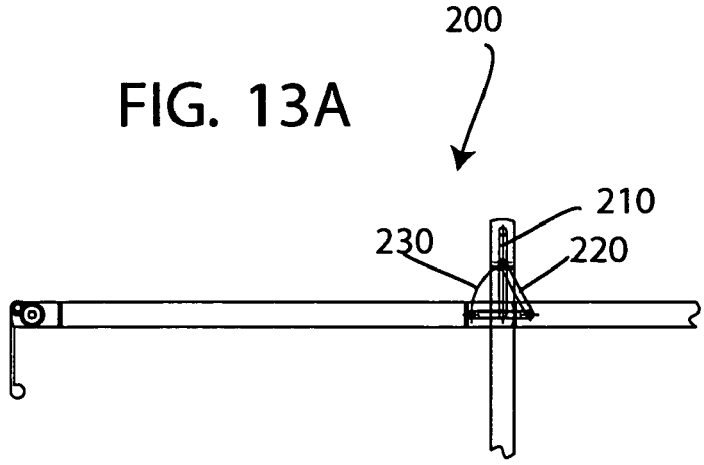
FIG. 13A is a top view of a hinge system shown in both an open and closed position.
Figure 13B:
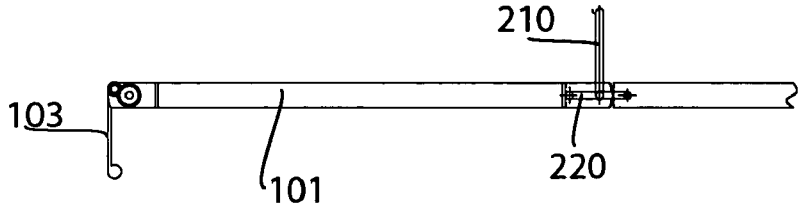
FIG. 13B is a top view of the hinge system shown in FIG. 13A wherein this embodiment shows the door in a closed position.
Figure 13C:
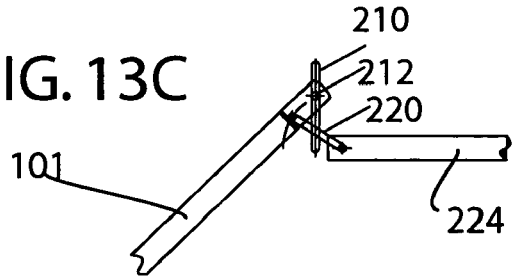
FIG. 13C is a top view of the hinge system shown in FIG. 13A wherein the door is shown in an open position.
Figure 13D:
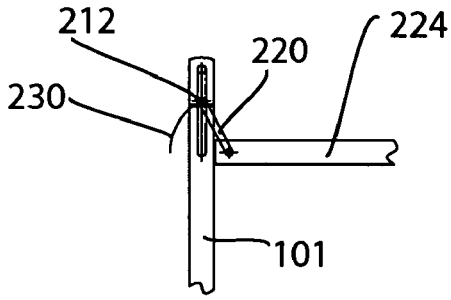
FIG. 13D is a top view of the hinge system shown in FIG. 13A wherein the door is shown in the open position.

FIGS. 13A, 13B, 13C and 13D show an embodiment of a hinge for door 101. With this design, FIG. 13A shows this hinge 200 both its open and closed positions. Offset hinge 200 includes a sliding track 210, wherein door 101 is slidable within sliding track 210 via a sliding pin 212. There is also a coupling or plate 220, which is rotatably coupled to door 101 and also to a stationary frame or wall 224. Plate 220 is rotatably coupled to both door 101 and also to frame or wall 224. Therefore, when door 101 rotates, it slides along sliding track 210 via sliding pin 212, as shown in FIG. 13C. Plate 220 rotates in its coupling to door 101 and also relative to frame or wall 224 so that door rotates relative to frame or wall 224 along a vertical axis offset from frame or wall 224. With this system, the substantially vertical axis of rotation moves relative to the position of the door. For example, the arrows shown in FIG. 13D show the path of the axis of rotation as door 101 rotates from a substantially open position wherein door 101 extends substantially perpendicular to an extension of wall 224 and a substantially closed position wherein door 101 extends substantially parallel or along wall 224.

Figure 14:
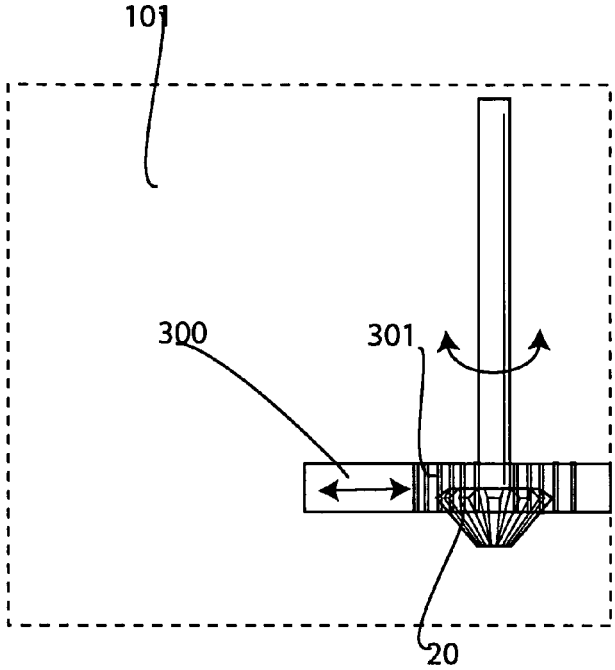
FIG. 14 is a top view of a first embodiment of a vent system.

FIG. 14 shows another embodiment of the invention wherein with this design, there is a slidable vent door or louvre 300 which is associated with either the geared system or embodiments, the pulley system or embodiments or the push-rod system or embodiments. With this design, vent or louvre door slides in a main door 101 so that it allows air to circulate and to break any atomospheric difference on both sides of the door as the door is opened. In the embodiment shown in FIG. 14, slidable vent door 300 contains a bevel gear 302 which works with gear 301. However, gear 301 can also work with an associated spur gear or any other type of gearing mechanism that can be used to drive louvre or slidable vent 300. Thus, as a handle or door rotates, this translates into a rotation of a shaft which then results in the rotation of gear 20 causing vent 300 to move axially to open up an air hole or louvre.

Figure 15:
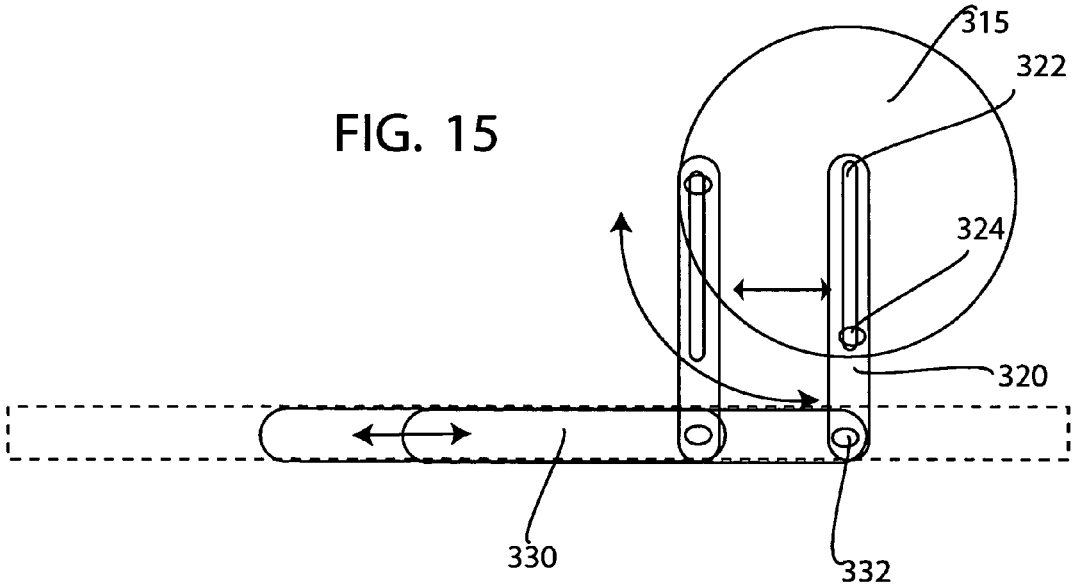
FIG. 15 is a top view of a second embodiment of a vent system.

FIG. 15 shows another embodiment wherein with this view there is a top view of a rotatable shaft 315 which has a coupling or plate 320 having a slidable track 322 coupled thereto. Coupling or plate 320 is coupled to rotatable shaft via a pin 324 formed in an eccentric region of rotatable shaft 315. Thus as shaft 315 rotates, it causes pin to rotate from a first position to a second position wherein this rotational movement of rotatable shaft 315 results in an axial movement of coupling 320 which results in vent or louvre door 330 opening. Coupling 320 is fixed to vent 330 via coupling pin 332 so that it does not rotate in relation to vent 330. Thus, as a user pulls on a handle, it causes rotatable shaft 315 to rotate causing pin 324 to rotate which results in an axial movement of coupling 320 which then results in an axial movement of louvre or vent 330 to open up ventilation for a door allowing for an easier opening of the door.

These ventilation systems can also work in conjunction with a transmission system such that as a user rotates a handle the rotation of the handle results first in the opening of the louvre or vent 300 or 330 and then results in a drive to open the door. This type of transmission may be accomplished via an offset planetary gearing system that first contacts a gearing system for a vent and then engages a gearing system for a door. In addition, any other type of gearing system for this type of successive interaction that is known in the art can also be used.

Accordingly, while at least one embodiment of the present invention has been shown and described, it is to be understood that many changes and modifications may be made thereunto without departing from the spirit and scope of the invention as defined in the appended claims.

What is claimed is:

1. A device for covering an opening, in buildings the openings having a frame the device comprising:

a covering;

at least one coupling for coupling said covering to a frame;

at least one rotatable handle, rotatably coupled to said covering;

at least one rotatable shaft coupled to said rotatable handle;

at least one stationary shaft coupled to said rotatable shaft;

at least one additional rotatable shaft, wherein said at least one rotatable shaft extends coaxially with an axis of rotation of said at least one rotatable handle and said at least one additional rotatable shaft is coupled to said at least one rotatable shaft so that when said at least one rotatable shaft rotates, it rotates said at least one additional rotatable shaft;

a plurality of gears, with a first one of said gears coupled to said at least one rotatable shaft, a second one of said gears coupled to said at least one additional rotatable shaft, and third one of said gears coupled to said stationary shaft wherein when a user rotates said handle, said at least one rotatable shaft and said first gear rotate, causing said at least one additional rotatable shaft to rotate around said third gear on said at least one stationary shaft causing said covering to rotate with respect to the frame.

2. The device as in claim 1, wherein said plurality of gears are bevel gears wherein a fourth one of said gears is coupled to said at least one additional rotatable shaft.

3. The device as in claim 2, wherein said at least one additional rotatable shaft has two ends and wherein said second and fourth gears are coupled to said ends of said additional rotatable shaft.

4. The device as in claim 3, wherein said third gear is fixedly coupled to the frame.

5. The device as in claim 4, further comprising a plurality of couplings for rotatably coupling said at least one rotatable shaft and said at least one additional rotatable shaft to said covering.

6. The device as in claim 4, wherein said at least one additional rotatable shaft extends diagonally from said stationary shaft said at least one rotatable shaft.

7. The device as in claim 3, wherein said at least one rotatable shaft extends perpendicular to said at least one additional rotatable shaft.

8. The device as in claim 7, wherein said covering is a door and said at least one rotatable shaft is positioned at a top region of said door.

9. The device as in claim 7, wherein said covering is a door and said at least one rotatable shaft is positioned at a bottom region of said door.

10. The device as in claim 1, wherein said covering is a door.

11. The device as in claim 1, wherein said covering is a window.

12. A device for covering an opening comprising:

a covering;

at least one hinge for coupling said covering to a frame;

at least one rotatable handle, rotatably coupled to said covering;

at least one rotatable shaft coupled to said rotatable handle;

at least one stationary shaft coupled to said rotatable shaft;

at least one additional rotatable shaft, having a rotatable axis extending substantially perpendicular to a rotatable axis of said at least one rotational shaft, wherein said at least one rotational shaft extends coaxially with a rotational axis of said at least one rotatable handle and said at least one additional rotatable shaft is coupled to said at least one rotatable shaft so that when said at least one rotatable shaft rotates, it rotates said at least one additional rotatable shaft;

a drive means for coupling said at least one stationary shaft, said at least one additional rotatable shaft, and said at least one rotatable shaft together, said drive means for rotating said handle when said covering rotates, wherein when said covering rotates with respect to the frame, said at least one additional rotatable shaft and said at least one rotatable shaft rotate around said at least one stationary shaft using said drive means and causing said at least one rotatable shaft and said rotatable handle to rotate as said covering is rotating.

13. A door disposed in a door frame, the door having a drive device comprising:

at least one rotatable handle rotatably mounted on said door;

at least one rotatable shaft fixedly coupled to said handle and rotatably mounted on said door;

at least one additional rotatable shaft extending substantially perpendicular to said at least one rotatable shaft and being rotatably mounted on said door;

at least one stationary shaft coupled to the frame; and a plurality of gears with at least one of said gears attached to each of said rotatable shaft, said additional rotatable shaft and said stationary shaft said plurality of gears meshing, so that when a user rotates said handle, said rotatable shaft rotates said additional rotatable shaft, wherein said additional rotatable shaft includes an additional gear selected from said plurality of gears which meshes with said gear coupled to said stationary shaft so that as said handle rotates said door rotates as well.

14. The door as in claim 13, wherein said handle is an elongated handle extending a majority of a height of the door.

15. The door as in claim 13, wherein said at least one rotatable handle rotates on approximately a 2:1 ratio with the door as the door rotates.

16. The door as in claim 13, wherein said plurality of gears are coupled to at least one gear box.

17. The door as in claim 16, wherein said at least one gear box is coupled to said door.

18. The door as in claim 13, wherein said gear of said at least one rotatable shaft comprises at least two spur gears, with a first one of said spur gears coupled to said at least one rotatable shaft and a second one of said spur gears coupled to a shaft extending out of at least one gear box, wherein said first spur gear meshes with said second spur gear for turning said gears inside said gear box and turning said at least one additional rotatable shaft.

19. The door as in claim 13, wherein said at least two spur gears offset said at least one rotatable shaft with respect said gear box to create a mechanical advantage for said handle within rotating said rotatable shaft.

20. The door as in claim 13, further comprising a plurality of curved handle supports coupled to said rotatable shaft and said handle coupled to said curved handle supports.

* * * * *